US005216860A

United States Patent [19]

Thomson et al.

[11] Patent Number: 5,216,860

[45] Date of Patent: Jun. 8, 1993

[54] BUILDING SYSTEM FOR REINFORCED CONCRETE CONSTRUCTION

[75] Inventors: Donald W. Thomson; Terry W. Seitz, both of Los Arcos, Costa Rica

[73] Assignee: Maploca of Illinois, Inc., Valparaiso, Ind.

[21] Appl. No.: 731,747

[22] Filed: Jul. 16, 1991

[51] Int. Cl.[5] ..... E04B 2/46

[52] U.S. Cl. ..... 52/259; 52/319; 52/422; 52/583; 52/586; 52/587

[58] Field of Search ..... 52/259, 319, 334, 421, 52/422, 583, 584, 587, 442, 285, 586, 437, 415

[56] References Cited

U.S. PATENT DOCUMENTS

| | | | |
|---|---|---|---|
| 2,171,540 | 9/1939 | Calkins et al. | 52/584 X |
| 3,175,652 | 3/1965 | Brekell et al. | 52/586 X |
| 3,511,000 | 5/1970 | Keuls | 52/586 X |
| 3,964,402 | 6/1976 | Jenne' et al. | 52/584 X |
| 4,158,938 | 6/1979 | Meechan et al. | 52/587 X |
| 4,207,718 | 6/1980 | Schaaf et al. | 52/586 X |
| 4,226,061 | 10/1980 | Day, Jr. | 52/586 X |
| 4,350,318 | 9/1982 | Gallis | 52/584 X |
| 4,989,386 | 2/1991 | Collis | 52/583 X |

FOREIGN PATENT DOCUMENTS

| | | | |
|---|---|---|---|
| 1427406 | 3/1976 | United Kingdom | 52/586 |

*Primary Examiner*—David A. Scherbel
*Assistant Examiner*—Kien T. Nguyen
*Attorney, Agent, or Firm*—Jones, Day, Reavis & Pogue

[57] ABSTRACT

A building system utilizing outwardly projecting legs on a horizontally or vertically extending purlin to connect with standard stirrups on conventional columns in a rebar assembly. The stirrups are force-fit within the legs of the purlins extending outwardly from the surface of adjoining wall sections such that the rebar and the wall sections are connected in a uniframe construction without welding and a metal form can be fitted around the connection to form a channel into which concrete may be poured to form a unitary structure.

34 Claims, 4 Drawing Sheets

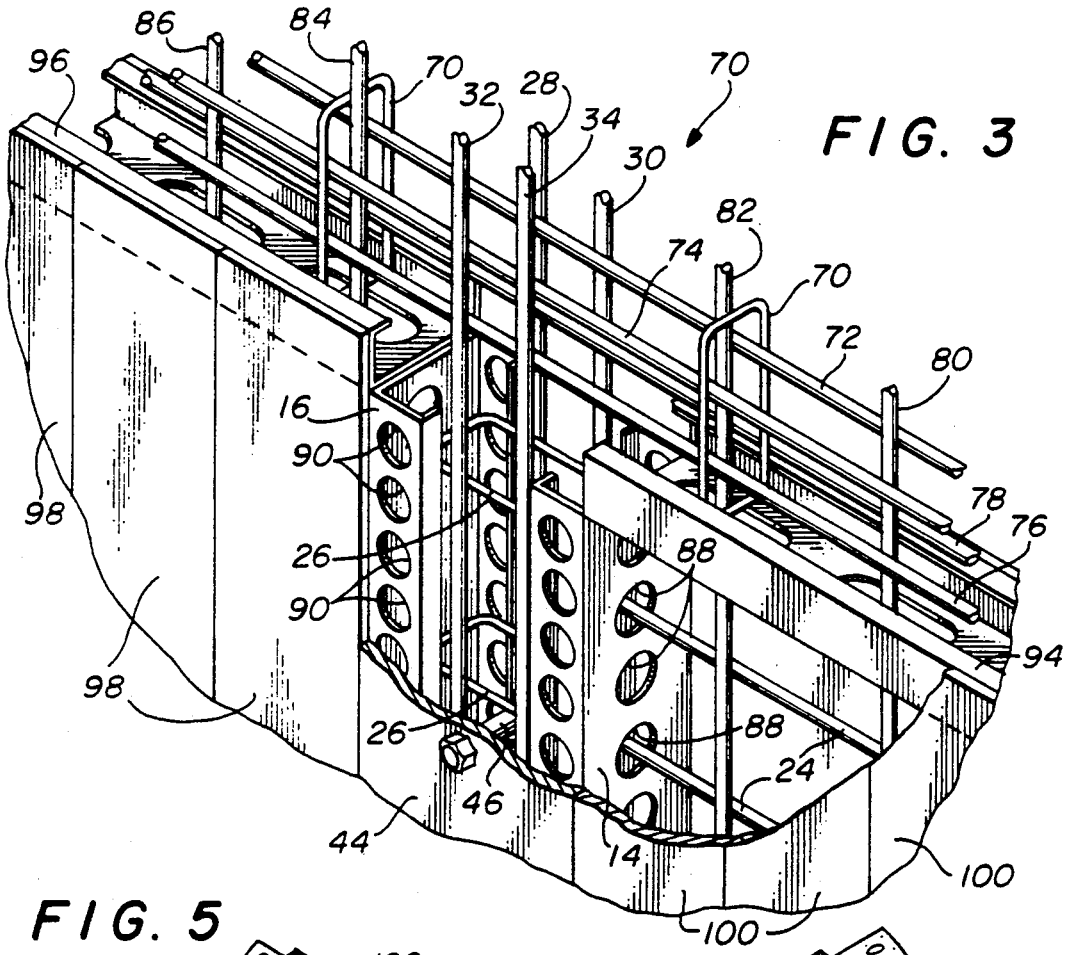
FIG. 3
FIG. 5
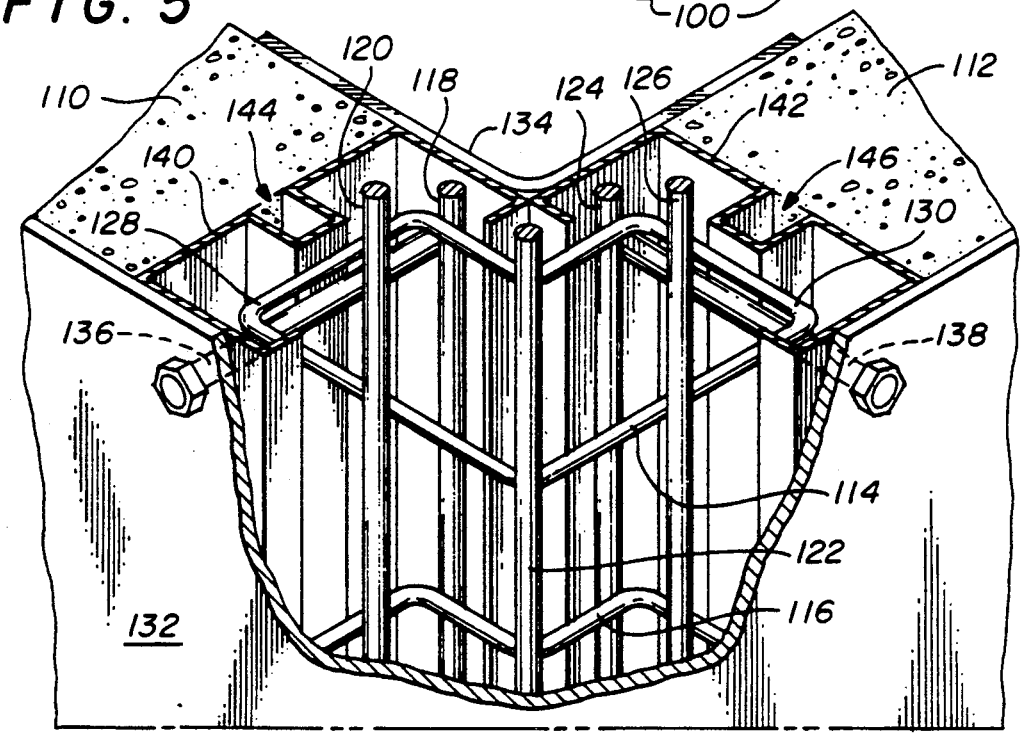

BUILDING SYSTEM FOR REINFORCED CONCRETE CONSTRUCTION

FIELD OF THE INVENTION

The present invention relates generally to the construction of the structural framework of a building or other structure of reinforced concrete and in particular to wall, column and beam forms which become integral parts of the structural framework.

BACKGROUND OF THE INVENTION

There are many systems for fabricating structural frameworks including the use of steel frameworks for industrial and residential buildings because they are comparatively inexpensive to build and can be assembled rapidly. These buildings, however, face a serious problem in their relatively low fire ratings since a fire can cause rapid expansion of steel columns and beams resulting in twisting and warping which may result in the necessity of complete replacement of the building.

Reinforced concrete offers substantial advantages over steel from the standpoint of fire rating and many specially designed concrete forms for such use have been proposed in the past. Some such forms are made of construction grade lumber and plywood which must be assembled into predetermined shapes for receiving poured concrete. Forms which are to be used multiple times may also be made from metals having the necessary rigidity and strength to support the weight of the fluid concrete during its pouring and initial stages of curing. These forms are made in many types and shapes and are provided with a variety of means for locking them in position for the pour and unlocking to facilitate their removal after the concrete is sufficiently hardened. Even with the use of forms, however, it is extremely difficult to place the reinforcing bar such that it will maintain a fixed relationship during the time the removable forms are being attached. Thus, there is a great deal of difficulty in the fabrication of such walls.

The present invention provides a new building system which combines the advantages of both reinforced concrete and steel frame structures in a very simple, efficient and economical manner. Specifically, the proposed building system utilizes outwardly projecting legs on a horizontally or vertically extending U-shaped member, known as a purlin, to connect with standard stirrups on conventional walls, coronas, columns or beams in a rebar assembly. In practice, the stirrups are force-fitted within the slot formed by the legs of the purlins extending outwardly from the surface of adjoining wall sections. In this manner, the rebar and the wall sections are connected in a uniframe construction without welding and a metal form can be fitted around the connection to form a channel into which fluid concrete may be poured.

The system may be used to connect precast concrete wall sections having purlins bolted or otherwise attached to the outer edges thereof with the slot of the U-shaped purlins extending outwardly from the surface of adjoining wall sections. The stirrups, generally rectangular in shape, hold the elongated reinforcing bars in spaced relationship and have an outside diameter that is substantially equal to the width of the outwardly facing slot in the purlin. Thus, each end of the stirrup members can be force-fit into the outwardly facing slot of a corresponding U-shaped purlin member of the adjacent wall panels to form a preliminary connection between the two panels. A removable form or plate may be attached on each side of a preliminary connection with the plates extending horizontally from concrete-panel-to-concrete-panel and vertically the length of the elongated reinforcing bars to form an enclosed channel such that a fluid concrete mixture poured into the enclosed channel fills the channel and joins the concrete panels in a permanent unitary structure.

In the preferred embodiment, at least one groove extends inwardly from the bottom wall of each U-shaped member to hold the end of the stirrup off the bottom wall such that poured fluid concrete can flow around a substantial portion of the stirrup member. Further, a plurality of orifices are formed in each side wall of each U-shaped member as well as in the bottom wall of the U-shaped member. Thus, poured fluid concrete can penetrate the plurality of side and bottom wall openings and provide continuous concrete inside and outside the U-shaped members to form a stronger joint. In addition, rebar protruding from the ends of prefabricated concrete wall sections can extend through the openings in the bottom wall into the center of the U-shaped members to be surrounded by poured concrete and provide a stronger connection between concrete panels. Also, a packing of gasket-seal material can be placed in the bottom of each rectangular spaced groove before the concrete wall panels are poured to form a moisture and vapor barrier between the U-shaped member and the concrete that extends the height of the concrete wall panels. In one version, the outer edges of the sides of the removable forms or plates are bent inwardly to contact the concrete panels and cause a space between the removable plate and the side walls of the U-shaped member so that poured concrete can penetrate the plurality of orifices in each side wall of the U-shaped member and provide continuous concrete inside and outside the U-shaped members. The plurality of openings formed in the bottom wall of each U-shaped member can also be used for receiving the ends of protruding reinforcing bars such that poured fluid concrete surrounds the ends of the protruding reinforcing bars to form a unitary structure.

The novel system also enables the formation of a unitary concrete structure without using preformed concrete wall panels.

Thus, it is one important object of the present invention to provide a simple and efficient manner of connecting preformed concrete panels to form a unitary wall section.

It is another important aspect of the present invention to provide a building system in which structural members can be easily formed with U-shaped purlins and elongated reinforcing bars.

SUMMARY OF THE INVENTION

Thus, the present invention relates to a building system for joining adjacent prefabricated concrete panels that have reinforcing bars protruding therefrom, the system comprising an elongated U-shaped member fixedly attached to the ends of eac prefabricated concrete panel with the U portion facing outwardly, each of the U-shaped members having a bottom wall and two side walls with a flange turned inwardly from the top of each side wall to form an outwardly facing slot having a predetermined width. A plurality of stirrup members, rectangular in shape, are attached to and hold a plurality of the elongated reinforcing bars in spaced relationship, said stirrup members having an outside width substantially equal to the width of the slot in the U-shaped member such that each end of the stirrup member can be force-fit into the outwardly facing slot of a corresponding U-shaped member on the adjacent panels to form a preliminary connection between the two panels, and means for attaching a removable plate on each side of the preliminary connection, the plates extending horizontally from concrete-panel-to-concrete-panel and vertically the length of the elongated reinforcing bars to form an enclosed channel such that a fluid concrete mixture poured into the enclosed channel fills the channel and joins the concrete panels in a permanent unitary structure.

The invention also relates to a building system for forming a unitary concrete structure comprising a plurality of rectangular shaped wall-forming elements, each element having elongated U-shaped members framing the top, bottom and sides of the element, each of the U-shaped members having a bottom wall and two side walls with a flange turned inwardly from the top of each side wall to form a slot having a predetermined width, said slots in the U-shaped members in adjacent elements facing each other, a plurality of elongated reinforcing bars, a plurality of stirrup members, rectangular in shape, attached to and holding the elongated reinforcing bars in spaced relationship, the stirrup members having an outside width substantially equal to the width of the slots in the U-shaped members such that each end of the stirrup member can be force-fit into the outwardly facing slots of corresponding U-shaped members of any adjacent elements to form a preliminary connection holding the elongated reinforcing bars between the adjacent elements to form a wall of a housing structure, and means for attaching a series of removable plates on each side of the interconnected elements, the plates extending vertically from the top-to-the-bottom and from side-to-side of the housing structure to form an enclosed channel such that a fluid concrete mixture poured into the enclosed channel fills the channel and joins the wall-forming elements in a permanent unitary housing structure.

BRIEF DESCRIPTION OF THE DRAWINGS

These and other objects of the present invention will be more readily apparent when taken in conjunction with the accompanying detailed description of the drawings and the attached figures in which like n represent like components and in which:

FIG. 3 is an isometric view of a wall section being formed with a part of the wall section exposed to view internal components thereof;

FIG. 5 is an isometric view of a corner of a building formed with the system of the present invention;

FIG. 1 is a top view of a T or union joint for coupling three walls together with the earthquake design of the present invention.

DETAILED DESCRIPTION OF THE DRAWINGS

Figure 1:
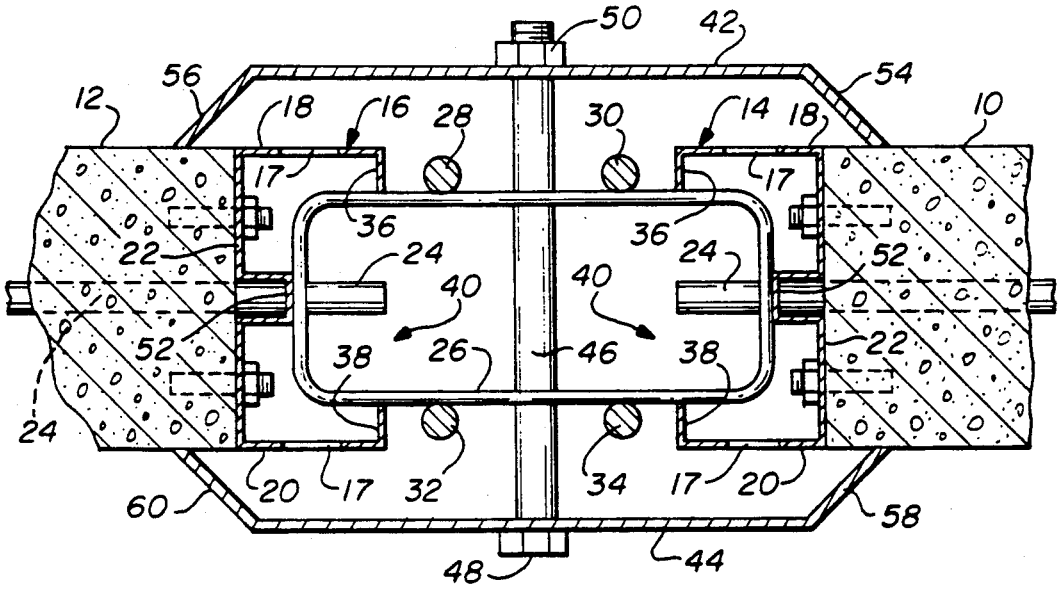
FIG. 1 is a top view of a preferred embodiment of the invention for forming a column connecting two prefabricated or freshly poured concrete wall sections.

FIG. 1 is a top view of a first embodiment of the novel system of the present invention for enabling a unitary wall section to be formed of prefabricated reinforced concrete panels. As can be seen in FIG. 1, which is a top view of the preferred embodiment, the two prefabricated concrete walls or panels 10 and 12 are to be joined together. Wall 10 has attached on the outer end thereof by means such as bolts 11 a vertical purlin 14, while concrete panel 12 has attached on its outer end by means such as bolts 13 a vertical purlin 16. Each of the purlins 14 and 16 has two side walls 18 and 20 and a bottom wall 22. Each of the two side walls 18 and 20 has a corresponding flange 36 and 38 turned inwardly from the top of each of the side walls 18 and 20 to form an outwardly facing slot 40 having a predetermined width. A plurality of elongated reinforcing bars 28, 30, 32 and 34 are attached to and held in spaced relationship by a plurality of stirrup members 26. The stirrup members 26 are rectangular in shape as shown and have an outside width substantially equal to the width of the slot 40 in the purlins 14 and 16 such that each end of the stirrup member 26 can be force-fit into the outwardly facing slot 40 of a corresponding U-shaped member 14 and 16 of the adjacent concrete wall panels 10 and 12 to form a preliminary connection between the two panels 10 and 12. Orifices are formed in the bottom 22 of each of the purlins 14 and 16 and can be better seen in FIGS. 3 and 4. These orifices allow horizontal rebar 24 to protrude from the concrete wall or panel 10 into the interior of the purlins 14 and 16.

In order to form a column interconnecting the two prefabricated concrete wall panels 10 and 12, plates 42 and 44 are placed on each side of the preliminary connection formed by the purlins 14 and 16 and the stirrups 26 with the rebar 28, 30, 32 and 34. A hollow tube 46 is placed between the plates 42 and 44 and a bolt 48 is coupled through aligned orifices in the plates 42 and 44 and tube 46. A nut 50 is placed on the other end of the bolt and tightened to hold the two plates 42 and 44 firmly against the concrete panels 10 and 12. Plates 42 and 44 extend horizontally from concrete panel 10 to concrete panel 12 and extend vertically the length of the elongated reinforcing bars 28, 30, 32 and 34 to form an enclosed channel such that a fluid concrete mixture poured into the enclosed channel fills the channel and joins the concrete panels 10 and 12 in a permanent unitary structure. Panels or plates 42 and 44 could be flat and abut against the outer surfaces of the concrete wall panels 10 and 12. However, in order to form a column and ensure a better connection between the concrete panels 10 and 12, the outer edges 54 and 56 of the sides of plate 42 and the outer edges 58 and 60 of the sides of plate 44 are bent inwardly to contact the concrete panels 10 and 12 and cause a space to exist between the purlins 16 and 18 and the plates 42 and 44. Orifices 17 are also formed in the side walls 18 and 20 of the purlins 14 and 16. This allows fluid concrete poured into the channel formed by the plates 42 and 44 to flow through the side wall orifices 17 and provide continuous concrete inside and outside the U-shaped purlins 14 and 16 to form a stronger connection. In addition, it will be noted that a groove or recess 52 is formed in the bottom wall 22 of the purlins 14 and 16. This causes the ends of the stirrup 26 to be held off of the bottom wall 22 to allow fluid concrete to flow around the ends of the stirrup 26, thus forming a more complete connection between the concrete and the stirrup 26.

Figure 2:
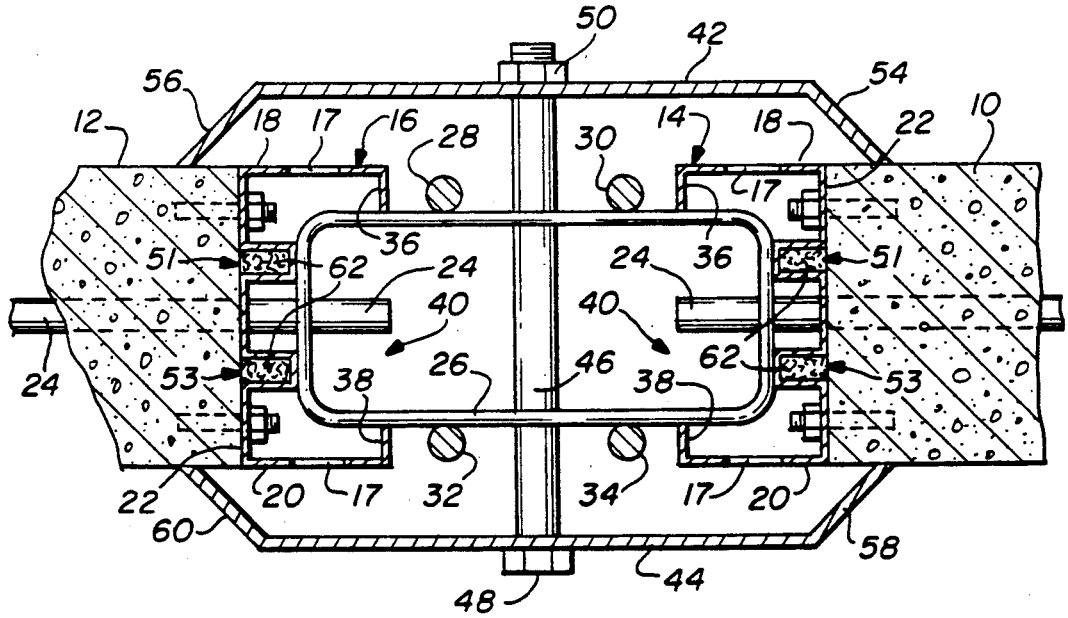
FIG. 2 is a top view of an alternate embodiment of a device for connecting two prefabricated concrete panels or forming a column connecting poured concrete wall sections.

In the alternate embodiment illustrated in FIG. 2, two grooves or recesses 51 and 53 are formed in each of the bases of purlins 14 and 16. Again, the function of these grooves or recesses is to hold the end of the stirrup 26 off the bottom wall 22 of the purlins 14 and 16 to enable fluid concrete to flow substantially around the stirrup 26 to form a better connection. The recesses 51 and 53 may be filled with a packing formed of well-known gasket-seal material 62. This material 62 forms a seal that provides a moisture and vapor barrier extending to the foundation of the structure when used with a bottom purlin with upwardly projecting legs as will be shown hereafter. It should be obvious from viewing FIGS. 1 and 2 that the concrete walls 10 and 12 need not be prefabricated, but could have other plates or forms forming the outer walls thereof with the rebar 24 and other necessary rebar within those walls and fluid concrete poured between those plates and the plates 42 and 44 to form a continuous concrete wall as will be disclosed hereafter.

FIG. 3 is an isometric view of a wall section prepared for pouring concrete with a portion of the interior partially exposed to disclose the details of the interconnection of the purlins and the stirrups with the rebar being held by the stirrups. As can be seen in FIG. 3, purlins 14 and 16 have the stirrups 26 inserted in the channels thereof with the stirrups 26 holding the elongated reinforcing bars 28, 30, 32 and 34 in spaced relationship as described earlier. In addition, horizontal purlins 94 and 96 have one end of stirrups 70 inserted in the respective channels thereof and stirrups 70 hold horizontal elongated reinforcing bars 72, 74, 76 and 78 in spaced relationship. The horizontal elongated reinforcing bars 72, 74, 76 and 78 can be tied to vertical reinforcing bars 28, 30, 32 and 34. If the wall being formed by the device of FIG. 3 is one where fluid concrete is going to be poured to form the entire wall section, internal vertical reinforcing bars or rods 80, 82, 84 and 86 extend through orifices 92 in the bottom wall of the horizontal purlins 94 and 96 to be tied or otherwise attached to the horizontal reinforcing bars 72, 74, 76 and 78. In like manner, the internal horizontal reinforcing bars 24 may extend through orifices 88 in the bottom walls of the vertical purlins 14 and 16 as discussed previously in relation to FIGS. 1 and 2. Abutting plates 44, 98 and 100 on both sides of the wall section provide forms for holding the poured concrete. They may be held in place as shown, for example, by the hollow tubes 46 extending between plates on each side of the wall and being held by bolts 48 as explained previously. The forms or plates 44 are shown in FIG. 3 to be flat. However, if a column is desired to be formed, they may be of the shape shown in FIGS. 1 and 2 to create a column or post. In that case, the poured concrete would pass through orifices 90 in the side walls of the vertical purlins 14 and 16 to completely surround the vertical purlins 14 and 16 as explained in relation to FIGS. 1 and 2.

Clearly, although FIG. 3 is shown to form a wall with freshly poured concrete, it is clear that two precast concrete walls could be joined as shown in FIG. 3 with the ends 24 of the horizontal rebar projecting from the precast concrete wall through orifices 88 into the center portion to be connected to vertical reinforcing bars 28, 30, 32 and 34.

Figure 4:
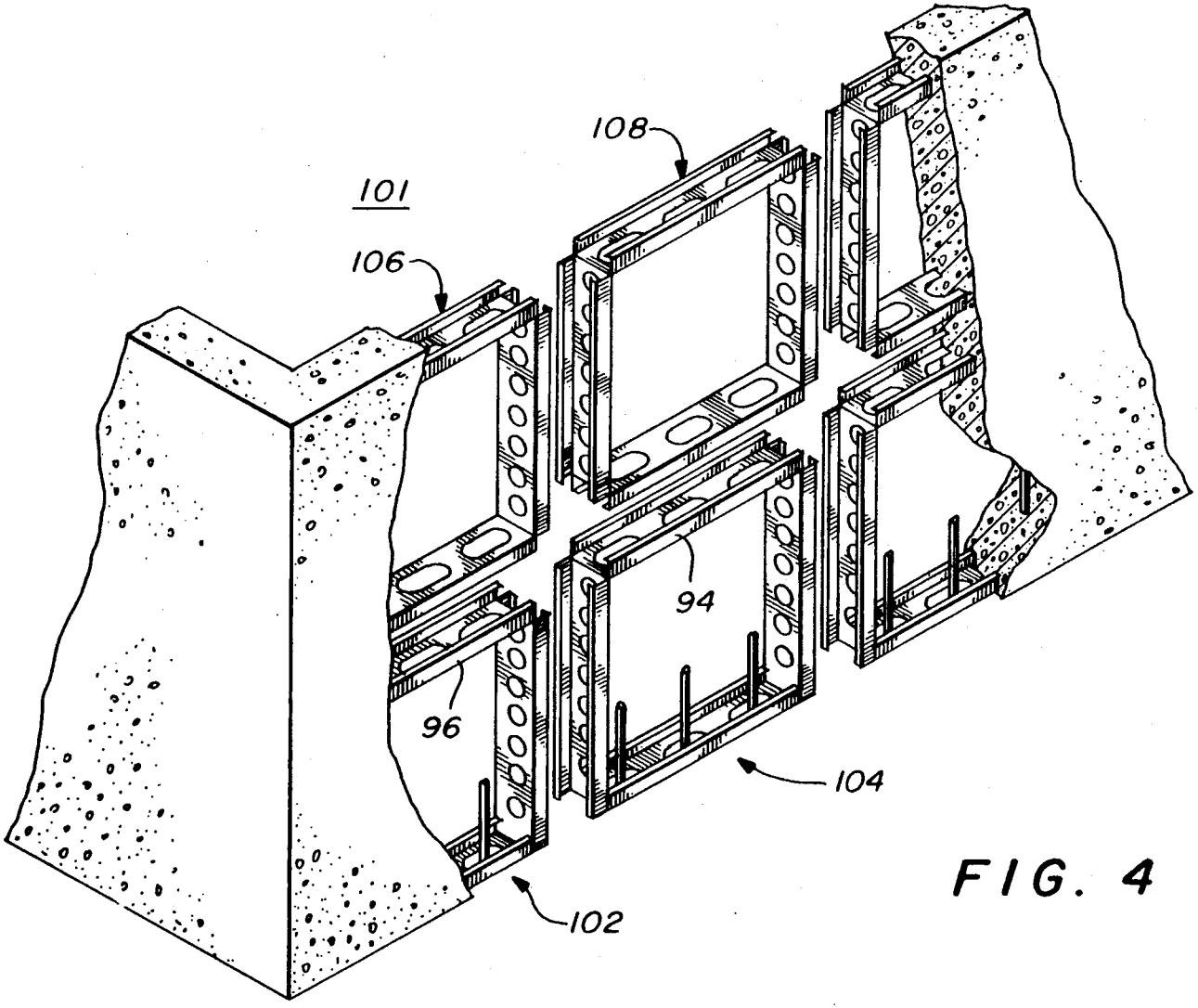
FIG. 4 is an isometric view of a wall section of a building structure showing part of the wall removed to expose the elements that hold the rebar in spaced relationship and enable the wall-forming elements to be coupled together.

It should be noted that with the system shown in FIG. 3, the concrete walls can be continued upwardly using the stirrups 70 to receive the channels of horizontal purlins on the base of the next upward panels. FIG. 4 illustrates a cutaway of the wall of a structure showing how both horizontal and vertical panels can be aligned for interconnection by use of stirrups according to the present system. Thus, the rectangular shaped wall-forming elements 102 and 104 have elongated U-shaped members framing the top, bottom and sides of the element. Each of the U-shaped members has a bottom wall and two side walls with a flange turned inwardly from the top of each side wall to form a slot having a predetermined width. The wall-forming elements 102 and 104 can be connected in a horizontal relationship with respect to each other by the system shown in FIG. 3. In addition, the rectangular shaped wall-forming elements 102 and 106 can be connected vertically to each other with the horizontal structure shown in FIG. 3 and the rectangular shaped wall-forming elements 104 and 108 can also be connected vertically to each other with the horizontal structure shown in FIG. 3, including the stirrups 70 and the horizontal reinforcing rods 72, 74, 76 and 78. In addition, of course, wall-forming elements 106 and 108 can be coupled to each other in the horizontal plane by the structure similar to that illustrated in FIG. 3. All of the reinforcing rods and the stirrups are not illustrated in FIG. 4 for simplicity of the drawings. However, they would simply use the system shown in FIG. 3 for both the horizontal and vertical connections to adjacent elements.

The corners of the structures may be joined and formed as an integral unit as illustrated in FIG. 5. In that case, assume that precast concrete walls 110 and 112 are to be joined as a corner. Vertical purlins 140 and 142 are to be bolted or otherwise attached to the prefabricated concrete wall panels 110 and 112 as explained earlier in reference to FIGS. 1 and 2. L-shaped stirrup members 114 and 116 are attached to reinforcing rods 118, 120, 122, 124 and 126 and hold them in spaced relationship. The ends 128 and 130 of the L-shaped stirrups are inserted by force in the slots of the vertical purlins 140 and 142 as explained previously. The ends 128 and 130 of the stirrups 114 and 116 rest on the inner surfaces of the depressions 144 and 146, again, as explained earlier. This allows poured fluid concrete to flow around the ends 128 and 130 of the stirrups 114 and 116. Plates or forms 132 and 134 are placed on each side of the corner and are held in spaced relationship in any manner as, for example, by hollow tubes 136 and 138. Bolts may then be inserted through the tubes and nuts placed on the other end to tighten them and hold the plates 132 and 134 securely in place as explained previously. Concrete can then be poured into the channel formed by the plates 132 and 134 to form the corner. Again, instead of joining prefabricated concrete panels 110 and 112, channels may be formed by plates on both sides of the proposed walls 110 and 112 and concrete can be poured to form walls plus adjoining corners.

Figure 6:
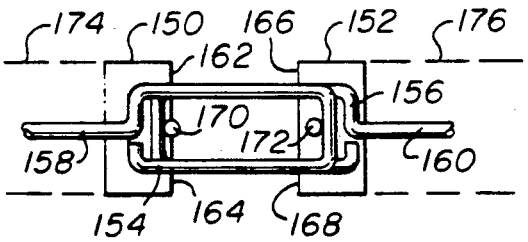
FIG. 6 is a top view of an alternate embodiment of the invention for forming a lock between the two adjacent panels to improve earthquake design.
Figure 7:
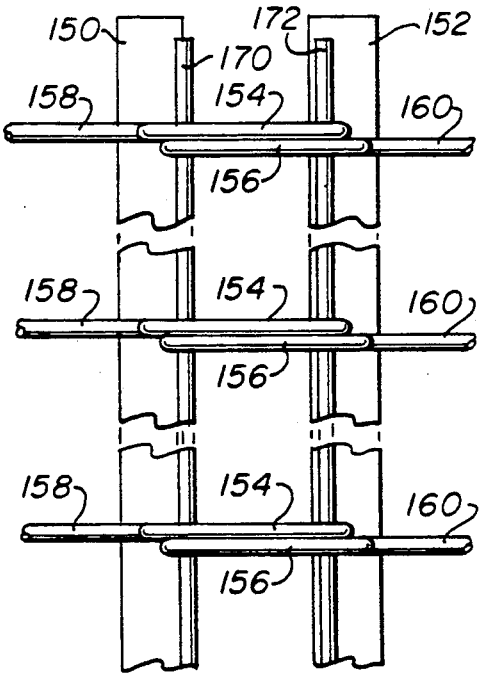
FIG. 7 is a side view of the device illustrated FIG. 6.

The embodiments illustrated in FIGS. 6–10 have been made to standardize and simplify the manufacturing process, expedite and simplify the on-site construction process and create a rebar assembly that is more resistant to torsion and earthquake damage. In the top view of the embodiment illustrated in FIG. 6, it can be seen that the purlins 150 and 152 are constructed as previously described in relation to FIGS. 1–5. However, the stirrup members 154 and 156 are integrally formed with the reinforcing bars 158 and 160, respectively. The stirrups 154 and 156 are still essentially rectangular in shape and fit into the slots formed by the shoulders 162 and 164 of the purlin 150 and the slot formed by shoulders 166 and 168 of purlin 152. Vertical rebar assemblies 170 and 172 are positioned against the outer end of each of the rectangular stirrups 154 and 156. In this manner, if rebar 166 has a tensile force applied thereto try to move it to the right, it is engaged with vertical reinforcing bar 170 and thus cannot move to the right. In like manner, if stirrup 154 is attempted to be moved to the left by a force applied to the reinforcing bar 158, it cannot move to the left because of the vertical reinforcing bar 172. Therefore, each of the stirrups 154 and 156 is not only held in place by the shoulders of the purlins 150 and 152 but also becomes an integral part of the concrete walls' reinforcing network through reinforcing rods 158 and 160 providing a much stronger structure in torsion. As can be seen in FIG. 6, the stirrup 154 from panel 174 is in overlapping and superimposed relationship with the stirrup 156 of the adjacent or adjoining panel 176. As described earlier in relation to FIGS. 1–5, the outer end of each stirrup 154 and 156 continues to enter into the slot formed by the purlin of the adjoining panel thus creating an alignment and friction fit as described earlier. As can be seen in FIG. 7, which is a side view of the structure illustrated in FIG. 6, the two stirrups 154 and 156 are in abutting relationship with each other. It can be clearly seen in FIG. 7 that any tensile forces to the right or left are resisted because of the interlocking configuration of the stirrups 154 and 156 with the purlins 150 and 152 and the vertical reinforcing bars 170 and 172.

Figure 8:
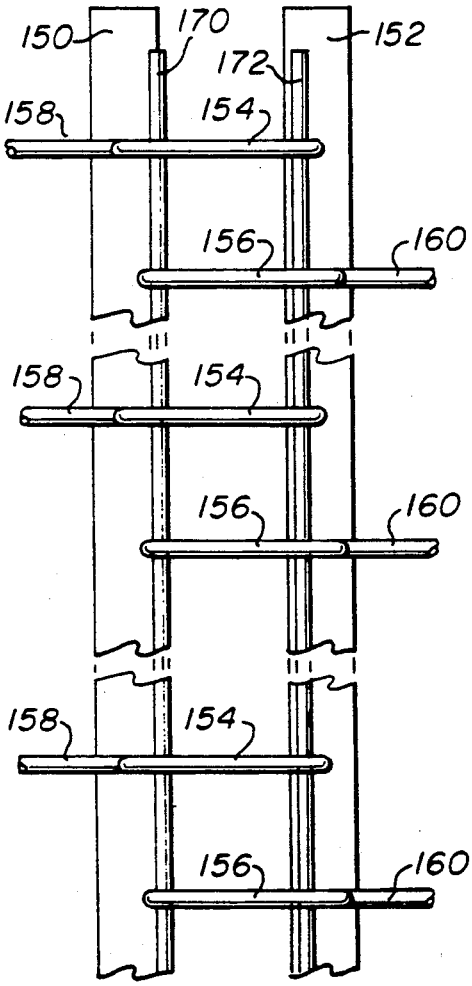
FIG. 8 is a side view of an ultimate design of the shown in FIG. 6.

Instead of stirrups 154 and 156 being in abutting relationship as illustrated in FIG. 7, they can be spaced from each other as illustrated in FIG. 8 so as to be in overlapping superimposed relationship with a space between them. With tensile forces applied, this will, however, apply a moment arm between stirrup 154 and 156 in an amount depending upon the separation distance.

Figure 9:
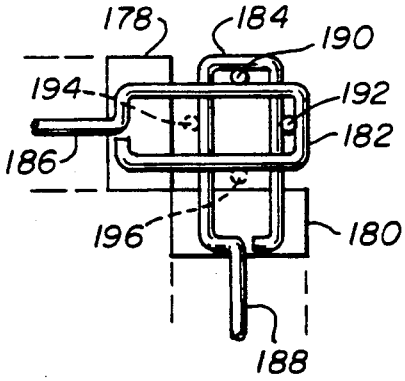
FIG. 9 is a top view of a corner connection utilizing the earthquake design of the present invention.

The shape of the stirrup-rebar assembly is standard and applies to corners and unions as wells. A corner is illustrated in FIG. 9. As can be seen in FIG. 9, the stirrups 182 and 184 are at right angles to each other. However, a portion of each of the stirrups fits within the slot of the respective purlins 178 and 180. Again, the stirrup 182 may be an integral part of reinforcing bar 186 while stirrup 184 may be an integral part of reinforcing bar 188. Alternatively, of course, the stirrup 182 may be welded to the end of reinforcing bar 186 while stirrup 184 may be welded to the end of reinforcing rod 188. At least one elongated reinforcing bar 190 is inserted within the rectangle formed by the overlapped rectangular stirrups 182 and 184 at and in contact with the end of the rectangle of stirrup 184 and rod 192 is inserted within the rectangle formed by the outer end of stirrup 182 and the side of stirrup 184 and, again, is in contact with the end of the rectangle 182 to create a lock between the stirrups 182 and 184 and the reinforcing rods 186 and 188 to resist any tensile force attempting to separate the U-shaped members 178 and 180. Additional elongated reinforcing bars 194 and 196 may be placed as indicated to provide additional reinforcement. Clearly, the stirrups 182 and 184 may be welded to the outer ends of the respective reinforcing rods 186 and 188 instead of being formed integrally therewith.

Figure 10:
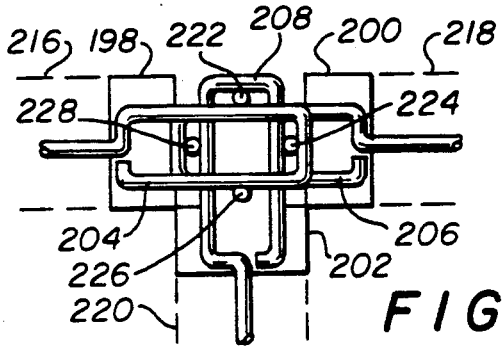

FIG. 10 illustrates a T or union connection of three walls 216, 218 and 220. Again, it will be seen that stirrup members 204 and 206 are in substantially overlapping superimposed relationship. The third stirrup 208 is in overlapping relationship with the other two. At least one reinforcing bar 222 is inserted within the rectangle formed by the overlapped stirrup member 208 and the stirrup members 204 and 206. The reinforcing bar 222 is in contact with the end of the stirrup member 208 to create a lock between stirrup 208 and stirrups 204 and 206 and the U-shaped members 198, 200 and 202 that resists any tensile force attempting to separate the U-shaped members. In like manner, reinforcing rod 204 is inserted within the rectangle formed by the overlapped rectangular stirrup members 204 and 206 at, and in contact with, the end of the stirrup 206 to create a lock between the stirrup 206 and the U-shaped members 198, 200 and 202 that resist any tensile force attempting to separate the U-shaped members. Finally, elongated reinforcing bar 224 may be inserted within the rectangle formed by the overlapped rectangular stirrup members 204 and 206 at and in contact with the end of stirrup member 204 to create a lock between the stirrups and the U-shaped members. An additional elongated reinforcing bar 226 may be placed on the outside surface of overlapped stirrup members 204 and 206 as shown to provide additional reinforcement. Reinforcing bar 228 may be placed between the outer end of stirrup 206 and the outside of stirrup 208 to prevent stirrup 206 from being pulled to the right and creating an additional lock.

Again, with the embodiments illustrated in FIGS. 9 and 10, the adjacent pairs of stirrup members from adjacent walls can be in abutting relationship as illustrated in FIG. 7 or in spaced relationship with each other as illustrated in FIG. 8. Thus, as illustrated in FIGS. 6, 7, 8, 9 and 10, the vertical reinforcing rods 170, 172, 190, 192, 194, 196, 222, 224, 226 and 228 are inserted from the top of the column assembly to create a lock between the stirrups and therefore the wall sections. This is very important to the earthquake design aspects of the invention. With the rods 190 and 192 placed as shown in FIG. 9, for instance, movement of the device in horizontal and vertical planes in FIG. 9 is restricted and delamination is eliminated. Placing the rebar into the channel or slot provided by the stirrups as indicated creates a very effective X, Y axis lock.

It should be understood that the joint illustrated in FIGS. 6, 9, and 10 can be used horizontally as well as vertically. Thus, in FIG. 6, the wall may be shown as a top view of two vertical walls or a side view of two horizontal walls. The same construction can be applied to FIGS. 9 and 10.

Thus, it can be seen that with the present invention the construction of a concrete structure is easily accomplished using the rectangular shaped wall-forming elements with the purlins having channels in their faces which can receive the rectangular ends of stirrups which hold the adjoining elements in spaced relationship and, in addition, provide attachments for the vertical and horizontal reinforcing rods. The use of such purlins to form rectangular shaped wall-forming elements enables concrete panels to be formed and attached to each other as integral units in either horizontal or vertical planes. In addition, they allow prefabricated concrete panels to be coupled to each other both horizontally and vertically.

Thus, there has been disclosed a novel building system for constructing concrete structures which is simple and efficient in use, which is relatively inexpensive and which enables the U-shaped purlins to remain with the structure.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any other known element having equivalent function.

We claim:

1. A building system for joining adjacent prefabricated concrete panels having reinforcing bars protruding therefrom, said system comprising:

an elongated U-shaped member fixedly attached to the ends of each prefabricated concrete panel with the U portion facing outwardly, each of the U-shaped members having a bottom wall and two side walls with a flange turned inwardly from the top of each side wall to form an outwardly facing slot having a predetermined width;

a plurality of elongated reinforcing bars;

a plurality of stirrup members having rectangular ends and that are associated with and hold the elongated reinforcing bars in spaced relationship;

the rectangular ends of said stirrup members having an outside width substantially equal to the width of said slot in said U-shaped member such that each end of the stirrup member can be force-fit into said outwardly facing slot of a corresponding U-shaped member of the adjacent panels to form a preliminary connection between the two panels; and means for attaching a removable plate on each side of the preliminary connection, said plates extending horizontally from concrete-panel-to-concrete-panel and vertically the height of the concrete panels to form an enclosed channel such that a fluid concrete mixture poured into the enclosed channel fills the channel and joins the concrete panels in a permanent unitary structure.

2. A building system as in claim 1 further including:

at least one groove extending from the bottom wall of each U-shaped member to hold the stirrup rectangular end off the bottom wall such that poured concrete can flow around a substantial portion of the stirrup member.

3. A building system as in claim 2 wherein the means for removably attaching a plate on each side of the preliminary connection comprises:

an orifice in each plate in aligned relationship;

a hollow tube extending between said plates and in alignment with the orifices; and a bolt extending through said plate orifices and the interior of said hollow tube for receiving a nut on one end that can be tightened to hold the plates in spaced relationship.

4. A building system as in claim 3 further comprising:

a plurality of orifices in each side wall of each U-shaped member; and means for spacing said removable plates from the side walls of the U-shaped member such that poured concrete can penetrate the plurality of side wall orifices and provide continuous concrete inside and outside said U-shaped members to form a strong connection.

5. A building system as in claim 4 wherein the outer edges of the sides of the removable plates are bent inwardly to contact the adjacent concrete panels and cause said space between the removable plate and the side walls of the U-shaped member.

6. A building system as in claim 2 wherein said at least one groove comprises first and second spaced rectangular shaped depressions extending inwardly from the bottom wall of the U-shaped member.

7. A building system as in claim 6 further comprising a packing of gasket-seal material placed in the bottom of each rectangular spaced depression before said concrete wall panels are poured to form a moisture and vapor barrier between the U-shaped member and the concrete extending the height of the concrete panels.

8. A building system as in claim 1 further including a plurality of openings in the bottom wall of each U-shaped member for receiving the ends of the protruding reinforcing bars such that poured concrete surrounds said ends of said protruding reinforcing bars to form a unitary structure.

9. A building system as in claim 1 further comprising at least one opening in the bottom wall of the U-shaped members for enabling reinforcing bar to extend therethrough and poured concrete to extend on both sides of said U-shaped members.

10. A building system for forming a unitary concrete structure comprising:

a plurality of rectangular shaped wall-forming elements;

each element having elongated U-shaped members framing the top, bottom and sides of the element, each of the U-shaped members having a bottom wall and two side walls with a flange turned inwardly from the top of each side wall to form a slot having a predetermined width;

said slots in said U-shaped members in adjacent elements facing each other;

a plurality of elongated reinforcing bars extending parallel to and generally between opposing ones of said U-shaped members;

a plurality of stirrup members, rectangular in shape, attached to and holding the elongated reinforcing bars in spaced relationship;

said stirrup members having an outside width substantially equal to the width of said slots in said U-shaped members such that each end of the stirrup member can be force-fit into the outwardly facing slots of corresponding U-shaped members of any adjacent elements to form a preliminary connection holding the elongated reinforcing bars between the adjacent elements to form a wall of a housing structure; and means for attaching a series of removable plates on each side of said interconnected elements, said plates extending vertically from the top-to-the-bottom and from side-to-side of said housing structure to form an enclosed channel such that a fluid concrete mixture poured into the enclosed channel fills the channel and joins the wall-forming elements in a permanent unitary housing structure.

11. A building system as in claim 10 further comprising an element including reinforcing bars for forming a corner that connects adjacent perpendicular wall structures.

12. A building system as in claim 11 wherein said corner-forming element further comprises:

a plurality of elongated reinforcing bars;

a plurality of L-shaped stirrup members, each leg of the L having at least an end portion substantially in the shape of a rectangle, said stirrup members being attached to and holding the elongated reinforcing bars in spaced relationship;

the ends of the wall structures adjacent the corner having said U-shaped members attached thereto with outwardly facing slots;

said L-shaped stirrup members having at least the end portion with an outside width substantially equal to the inside width of said slot in said U-shaped members such that each rectangular end of each leg of the L-shaped stirrup member can be force-fit into the outwardly facing slot of a corresponding U-shaped member on said end of each wall structure adjacent the corner to form a preliminary connection between the two wall structures;

a first elongated curved plate extending around the outside of said corner and a second elongated curved plate extending around the inside of said corner; and means for removably attaching the first and second plates to each other to form an enclosed corner channel such that a fluid concrete mixture poured into the enclosed corner channel fills the channel and joins the wall structures together at the corners to form a unitary structure.

13. A building system as in claim 12 further including at least one groove extending inwardly from the bottom wall of each U-shaped member to hold the stirrup rectangular end off the bottom wall such that poured fluid concrete can flow around a substantial portion of the stirrup member.

14. A building system as in claim 13 wherein the at least one groove comprises first and second spaced rectangular shaped depressions extending inwardly from the bottom wall of the U-shaped member.

15. A building system as in claim 14 further comprising a packing of gasket-seal material placed in the bottom of each rectangular spaced depression before said U-shaped members are attached to the concrete wall panels to form a moisture and vapor barrier between the U-shaped member and the concrete extending the height of the concrete panels.

16. A building system as in claim 15 further including a plurality of openings in the bottom wall of each U-shaped member for receiving the ends of the protruding reinforcing bars such that poured concrete surrounds said ends of said protruding reinforcing bars to form a unitary structure.

17. A building system as in claim 12 wherein the means for removably attaching the first and second curved plates to each other to form a corner channel comprises:

an orifice in each plate in aligned relationship;

a hollow tube extending between said plates and in alignment with the orifices; and a bolt extending through said orifice and the interior of said hollow tube for receiving a nut on one end that can be tightened to hold the plates in spaced relationship.

18. A building system as in claim 17 further comprising:

a plurality of orifices in each side wall of each U-shaped member; and means for spacing said removable plates from the side walls of the U-shaped member such that poured concrete can penetrate the plurality of side wall orifices and provide continuous concrete inside and outside said U-shaped members to form a strong connection.

19. A building system as in claim 18 wherein the outer edges of the sides of the removable plates are bent inwardly to contact the adjacent concrete panels and cause the space between the removable plate and the side walls of the U-shaped member.

20. A building system as in claim 10 further comprising at least one opening in the bottom wall of the U-shaped members for enabling reinforcing bar to extend therethrough and poured concrete to extend on both sides of the U-shaped members.

21. A building system for forming a unitary wall structure comprising:

a plurality of wall-forming elements;

each of said elements having at least one elongated U-shaped member projecting from at least one side thereof;

each U-shaped member having a bottom wall and two side walls with a flange turned inwardly from the top of each side wall to form a slot having a predetermined width; said slots in said U-shaped members projecting from adjacent elements in a manner such that said slots face each other; and a plurality of stirrup members structured and dimensioned to be force-fit into the facing slots of said U-shaped members projecting from adjacent elements to preliminarily interconnect the adjacent elements forming a wall structure.

22. A building system as in claim 21 including means for attaching a series of removable plates on each side of said interconnected elements, said plates extending vertically from the top-to-the-bottom and from side-to-side of said wall structure to form an enclosed channel such that a fluid concrete mixture poured into the enclosed channel fills the channel and joins the wall-forming elements in a permanent unitary housing structure.

23. A building system as in claim 21 wherein each of said elements has said U-shaped member projecting from the top, bottom and sides thereof.

24. A building system as in claim 21 wherein said stirrup members are rectangular in shape.

25. A building system for joining adjacent prefabricated concrete panels having reinforcing bars protruding therefrom, such system comprising:

an elongated U-shaped member fixedly attached to the ends of each prefabricated concrete panel with the U portion facing outwardly, each of the U-shaped members having a bottom wall and two side walls with a flange turned inwardly from the top of each side wall to form an outwardly facing slot having a predetermined width;

a plurality of openings in the bottom wall of each U-shaped member for receiving the ends of the protruding reinforcing bars such that poured concrete surrounds at least a portion of the protruding reinforcing bars to form a unitary structure;

a plurality of rectangular stirrup members, each rigidly attached to the end of a corresponding protruding reinforcing bar, the stirrup members from adjacent panels being at least partially in superimposed overlapping relationship, said overlapped stirrup members forming a rectangle;

the ends of each rectangular stirrup member having an outside width substantially equal to the width of said slot in said U-shaped member such that each end of the stirrup member can be force-fit into said outwardly facing slot of the corresponding U-shaped member of the adjacent panels to form a preliminary connection between the two panels;

at least one elongated reinforcing bar inserted perpendicular to the end of each overlapped rectangular stirrup member at, and in contact with, a respective outer end of each rectangle to create a lock between the stirrups and the U-shaped members that resist torsion and tensile forces attempting to separate the U-shaped members; and means for attaching a removable plate on each side of the preliminary connection, said plates extending horizontally from concrete-panel-to-concrete-panel and vertically the height of the concrete panels to form an enclosed channel such that a fluid concrete mixture poured into the enclosed channel fills the channel and joins the concrete panels in a permanent unitary structure.

26. A building system as in claim 25 wherein each of said stirrup members is integrally formed with a corresponding protruding reinforcing bar.

27. A building system a in claim 26 wherein each successive pair of overlapped stirrups from adjacent elements abut each other in said at least partially superimposed overlapping relationship to provide a resistance to tensile force substantially without a moment arm.

28. A system as in claim 27 wherein the stirrups are at right angles to each other to form a corner union.

29. A system as in claim 27 wherein each successive pair of overlapped stirrups is overlapped by a third stirrup at right angles to form a T-shaped union for coupling three concrete panels together.

30. A building system for forming a unitary concrete structure comprising:

a plurality of rectangular shaped wall-forming elements;

each element having an elongated U-shaped members framing the top, bottom and sides of the element, each of the U-shaped members having a bottom wall and two side walls with a flange turned inwardly from the top of each side wall to form a slot having a predetermined width;

said slots in said U-shaped members in adjacent elements facing each other;

a plurality of spaced orifices formed in the bottom of each U-shaped member;

a first elongated reinforcing bar having an outer end extending through each of at least some of the spaced orifices in a direction perpendicular to the bottom of said U-shaped member;

a stirrup member, rectangular in shape, rigidly coupled to the outer end of a corresponding first elongated reinforcing bar and positioned between said U-shaped members;

said stirrup members from corresponding first bars and adjacent elements being in substantially superimposed overlapping relationship with each other;

said stirrup members having an outside width substantially equal to the width of said slots in said U-shape members such that each end of the stirrup member can be force-fit into the outwardly facing slots of corresponding U-shaped members of any adjacent elements to form a preliminary connection holding the elongated reinforcing bars between the adjacent elements to form a wall of a housing structure;

a second elongated reinforcing bar inserted within said overlapped rectangular stirrups at, and attached to, each end of the rectangle to create a lock between the stirrups and the wall-forming elements resisting any tensile force attempting to separate the wall-forming elements; and means for attaching a series of removable plates on each side of said interconnected elements, said plates extending vertically from the top-to-the-bottom and from side-to-side of said housing structure to form an enclosed channel such that a fluid concrete mixture poured into the enclosing channel fills the channel and joins the wall-forming elements in a permanent unitary housing structure.

31. A building system as in claim 30 wherein each of the stirrup members is integrally formed with a corresponding first reinforcing bar.

32. A building system as in claim 31 wherein each successive pair of overlapped stirrups from adjacent elements abut each other in said at least partially superimposed overlapping relationship to provide a resistance to tensile force substantially without a moment arm.

33. A building system as in claim 30 wherein said elements are coupled to each other in a perpendicular manner to form a corner union.

34. A building system as in claim 30 wherein three of said rectangular shaped wall-forming elements are perpendicular to each other to form a T-shaped union of the wall-forming elements.

* * * * *